US005277000A

United States Patent [19]

Demuth et al.

[11] Patent Number: 5,277,000

[45] Date of Patent: Jan. 11, 1994

[54] APPARATUS FOR GRINDING CLOTHING, SUCH AS THE CLOTHING OF A CARDING CYLINDER OR CLEANING CYLINDER

[75] Inventors: Robert Demuth, Nurensdorf; Peter Fritzsche, Winterthur; Roland Soltermann, Zurich; Erich Hohloch, Winterthur; Christian Sauter, Flurlingen; Urs Meyer, Niederglatt, all of Switzerland

[73] Assignee: Maschinenfabrik Rieter AG, Winterthur, Switzerland

[21] Appl. No.: 826,851

[22] Filed: Jan. 28, 1992

[30] Foreign Application Priority Data

Jan. 29, 1991 [CH] Switzerland ..... 00267/91

[51] Int. Cl.[5] ..... B24B 19/18

[52] U.S. Cl. ..... 51/242

[58] Field of Search ..... 51/242, 243

[56] References Cited

U.S. PATENT DOCUMENTS 4,575,972 3/1986 Ohki et al. ..... 51/242

4,984,395 1/1991 Demuth ..... 51/242

FOREIGN PATENT DOCUMENTS 0322637 7/1989 European Pat. Off. .

2365924 1/1977 Fed. Rep. of Germany .

*Primary Examiner*—Roscoe V. Parker

*Attorney, Agent, or Firm*—Sandler, Greenblum & Bernstein

[57] ABSTRACT

In order to grind clothing of a carding element, such as a cylinder of a textile machine, such as a card, during operation of the cylinder, a slide is moved back-and-forth across the clothing. The slide is reciprocated back-and-forth by an inner run of a drive belt guided in guides such that the drive belt together with a grinding element, like a grinding stone, closes a housing totally covering the arrangement. As a result, neither grinding dust nor fibers can enter the housing. Each time the grinding stone moves past a grinding member, such as a diamond rake or diamond roller this grinding stone is re-ground, so that the clothing is maintained sharpened by the continuous grinding operation and the grinding stone itself is cleaned or re-ground by the grinding member. Also, structure detects the degree of wear of the grinding element so that upon reaching a predetermined value such grinding element can be replaced.

32 Claims, 7 Drawing Sheets

Fig.2
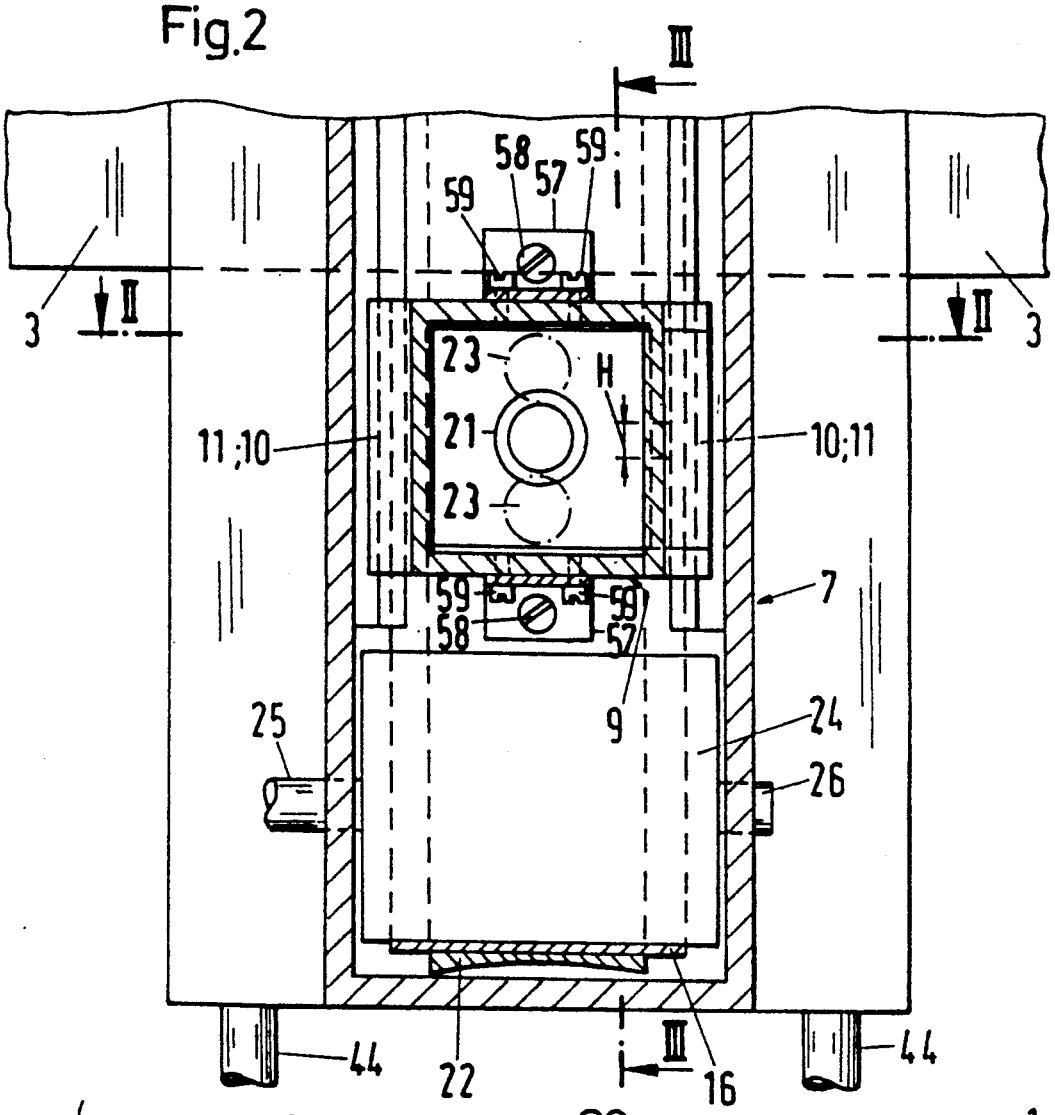
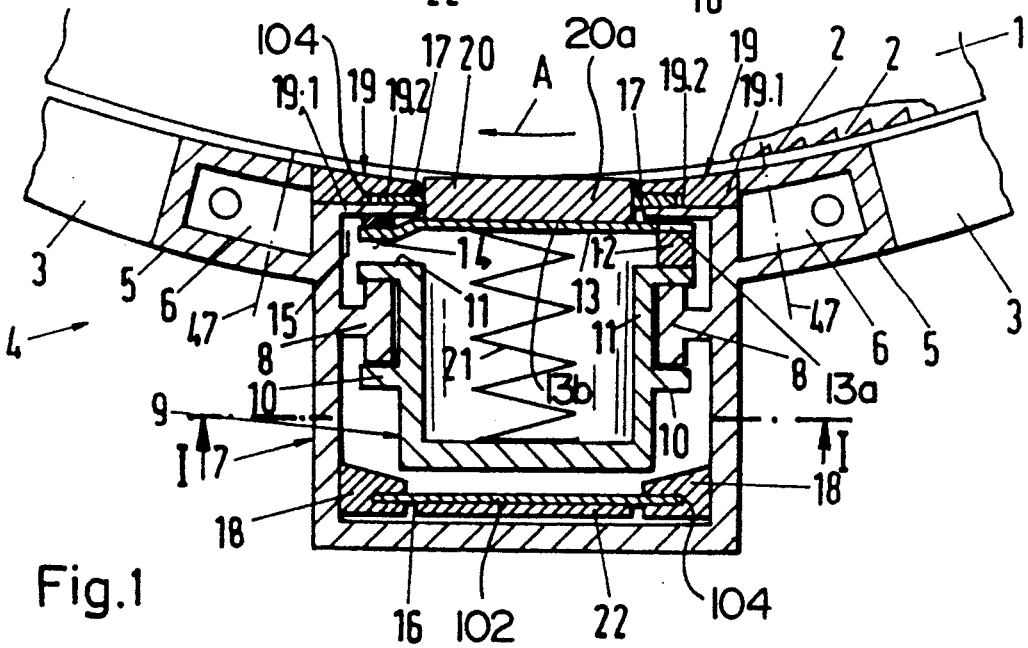
Fig.1

102
22
25
28
20
40
41
37.1
30
17
16
56
58
24
57
59
29
100
42
37.1
36.1
35
40
20
7
30
37
39
38
36
35
56
58
57
59
9
31
8
33
1
34
15
33
32
2

Fig.11
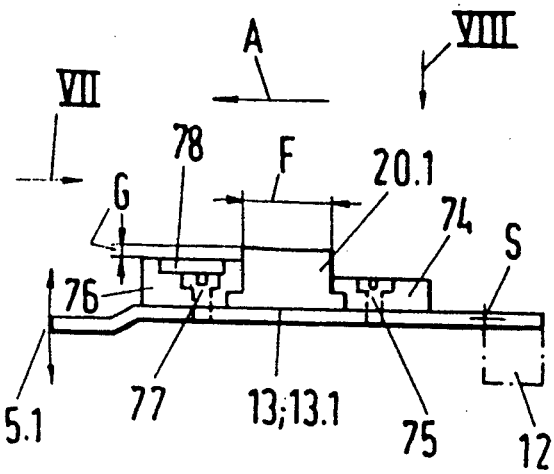
Fig.12
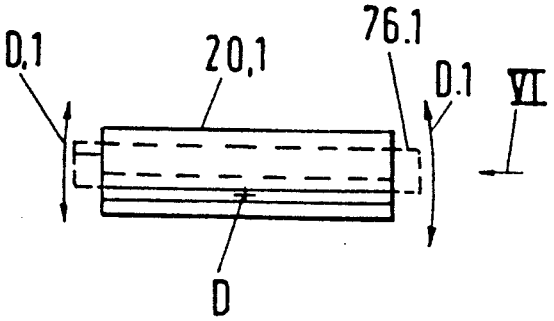
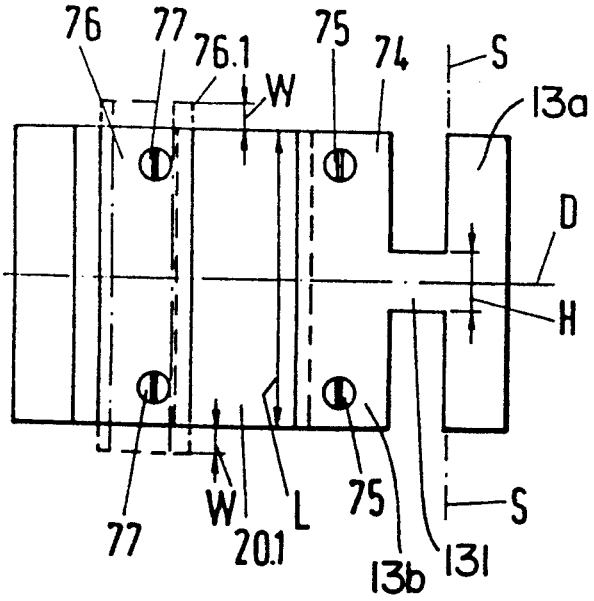
Fig.13

APPARATUS FOR GRINDING CLOTHING, SUCH AS THE CLOTHING OF A CARDING CYLINDER OR CLEANING CYLINDER

BACKGROUND OF THE INVENTION

1. Field of the Invention

The present invention relates to a new and improved apparatus for grinding the clothing of a carding element of a textile machine, such as the clothing of a carding cylinder or a cleaning cylinder.

Generally speaking, the apparatus for grinding clothing of a textile machine, which clothing is mounted at a carding element of the textile machine, such as a cylinder or roller, for instance, a main carding cylinder, a licker-in or a doffer of a carding machine, or at a revolving flat of a carding machine, is of the type comprising a grinding element movable essentially perpendicular to the direction of movement of the clothing and throughout the entire width of the clothing of the carding element, such as the cylinder. This grinding element is supported at an entrainment member, preferably a slide or carriage, guided in guide means. Drive means move the slide or carriage over the clothing in order to accomplish the aforementioned movement of the grinding element.

2. Discussion of the Background and Material Information

In a carding machine or card, the opening roller or cylinder (also known as the licker-in), the main carding cylinder, the doffer roller or cylinder (also known as the doffer) as well as the revolving flats, are each covered with clothing. Depending upon which carding element of the carding machine is covered with clothing, such clothing can differ from element to element, particularly as concerns the revolving flats which also can be covered with needle clothing in contrast to the toothed clothing of the remaining elements.

The increase in production in the so-called cleaning room and the carding room of a spinning mill, which has taken place in the past fifteen years, has imposed requirements upon the processing operations of the textile machines which have increased more than just linearly with respect to the increase in production.

In particular, of paramount importance is the need not to have to tolerate any impairment in the quality of the processed fibers, especially not to have to accept any additional damage to the fibers, notwithstanding the increased productivity or output of the textile machine.

Furthermore, a particularly important aspect is the service or operating life of the so-to-speak "tools" with increased productivity or output, since with greater machine productivity there is a corresponding decrease in the service or operating life of the tools. As a result, these tools need to be replaced more frequently.

The just mentioned service or operating life not only is significant in terms of the servicing or maintenance work required during exchange of the tools, but even more so, as concerns the altered technological result which likewise correspondingly changes as a result of wear of the tools.

Just as is the case in other technological fields where products are continually processed or machined with predetermined settings of the employed tools, it is also important in the spinning mill, as concerns the attained technological result, that these results are as consistent as possible. Stated in another way, for the further processing of yarn it is totally undesirable to have quality fluctuations present in the fibers due to the changing susceptibility to disturbances. As a specific example, it is noted that it is generally preferable to have a uniform, somewhat poorer quality of the fibers in contrast to a somewhat better average quality of the fibers which, however, is constituted by considerable up and down or wide band fluctuations in the quality of the fibers within such better quality range.

A tool which is used in the spinning mill and which is especially prone to the aforementioned wear phenomenon, is the toothed clothing used for opening fiber flocks including that used for carding thereof.

In particular, the carding machine or card, which ultimately produces the sliver to be delivered to the drawing frame, constitutes the last machine which operates with such type tool. In other words, the card represents the last piece of equipment where there is available an opportunity to avoid such fluctuations.

Those skilled in the textile art are aware of the fact that, for example, card clothing, after experiencing a predetermined maximum amount of wear, must be replaced. Yet, until such time as there occurs such maximum wear of the card clothing, such clothing is repeatedly sharpened or re-ground by using various types of commercially available grinding apparatuses. For this purpose it is not only necessary to shutdown the card, but also to partially dismantle the same in order to provide the space needed to have access to the clothing for grinding such with a grinding tool.

In the commonly assigned European Published Patent Application No. 0,322,637, published Oct. 16, 1991, and the cognate U.S. Pat. No. 4,984,395, granted Jan. 15, 1991, entitled "Grinding Device and Method for Grinding Card Clothing", there is disclosed a method and apparatus for grinding card clothing where such grinding of the card clothing is accomplished, and specifically, continuously, during carding of the textile fibers. As a result, prior to the time that the clothing is replaced, there is no need to shutdown or partially dismantle the card whenever the card clothing is reground.

In this just mentioned prior art grinding device or apparatus there is used a grinding element movable over the entire width of the cylinders covered with clothing. This grinding element is supported by an entrainment member guided in guides. The grinding element is continuously displaced over the clothing at predetermined intervals dependent, for instance, upon the production output and/or quality attributes of the processed fibers. Here, it is also of no consequence that the clothing contains a fiber layer.

However, experience has proven that also such a grinding element, typically constituted by a grinding stone, is prone to wear, that is to say, the grinding stone becomes less sharp, so that such grinding stone itself must be periodically removed, either to be replaced by a new grinding stone or must be re-sharpened.

SUMMARY OF THE INVENTION

Therefore, with the foregoing in mind, it is a primary object of the present invention to provide an improved apparatus for grinding the clothing of a textile machine which is not afflicted with the aforementioned limitations and drawbacks of the prior art.

Another and more specific object of the present invention is concerned with the provision of an improved apparatus for grinding the clothing of a textile machine which reliably eliminates the aforementioned drawback of having to remove the grinding element, such as the grinding stone, by providing means for grinding or re-sharpening the grinding element of the grinding apparatus while mounted at the textile machine, thereby increasing the service or operating life of such grinding element.

Still a more specific object of the present invention, and in keeping with the immediately preceding object, is directed to the provision of grinding or sharpening means at the textile machine which roughens or re-sharpens the grinding element itself after a predetermined number of operable grinding passes thereof at the clothing, for example, at least after every second pass, so that in conjunction with the grinding of the clothing not only the clothing but also the grinding element exhibits a continuous sharpness or hone.

Yet a further noteworthy object of the present invention is concerned with the provision of an improved apparatus for grinding the clothing of a textile machine and equipped with means for detecting and indicating a predetermined condition of wear of a grinding element of the grinding apparatus used for grinding the clothing of the textile machine.

The apparatus for grinding the clothing of a textile machine of the present development is manifested, among other things, by the features that the drive means comprises a flexible drive belt or band which is guided in suitable guides or guide means, and such flexible drive belt or band is operatively connected with the grinding element in order to move the grinding element over the clothing.

According to the present invention, the flexible drive belt is connected with the slide in such a manner and the guide means for guiding the flexible drive belt are arranged in such a manner that the flexible drive belt and the grinding element conjointly seal a space directly beneath the clothing. In other words, there is substantially sealed the space directly in front of the grinding element, as viewed from the clothing, in relation to the space behind the grinding element.

Still further, cover means can be provided for the flexible drive belt before and after the grinding element, as viewed with respect to a predetermined direction of movement of the flexible drive belt, for substantially filling the space between the clothing and the flexible drive belt.

According to a further feature, the guide means for guiding the flexible drive belt are provided with air entry openings or air channels and a source of compressed air blows in compressed air through the air entry openings or air channels.

Still further, the guide means for guiding the flexible drive belt comprise guide surfaces provided with groove means arranged substantially at right angles to the predetermined direction of movement of the flexible drive belt and which extend substantially throughout the entire width of the region of contact of the flexible drive belt at the guide surfaces. The region of contact of the flexible drive belt at the guide surfaces extends in the same direction as the predetermined direction of movement of the flexible drive belt.

It is also contemplated to provide pressing means, such as spring means for pressing the grinding element against the clothing.

As to a further aspect, a blade spring can connect the grinding element with the slide. This blade spring has a spring web located over the extensively freely movable grinding element and this spring web is located between the slide and the grinding element. The spring web has a width, as viewed in the predetermined direction of movement of the grinding element, which constitutes a fraction of the length of the grinding element.

Also the present invention envisages providing a grinding member for re-grinding the grinding element. This grinding member may comprise a diamond rake arranged externally of the clothing at an edge of the main carding cylinder or may comprise a diamond roller or wheel covered with diamond dust which is arranged externally of the main carding cylinder.

Furthermore, there may be provided additional guide means for guiding the grinding element for re-grinding thereof by the grinding member at a sufficient distance from the clothing and externally of a card flange defining an end wall of the card constituting the textile machine. Such additional guide means is advantageously structured for guiding the grinding element for re-grinding thereof at both sides of the clothing. Moreover, such additional guide means can serve for guiding the grinding element at a sufficient distance from the clothing and externally of the card flange defining the end wall of the card constituting the textile machine to enable replacement of the grinding element.

The present invention further conceives of providing a magnetic plate which is arranged after the grinding element with respect to the predetermined direction of rotation of the main carding cylinder.

Also a suction nozzle can be arranged after the grinding element with respect to the predetermined direction of rotation of the main carding cylinder, and a controllable flap member can serve for closing the suction nozzle.

According to a further feature of the present invention there can be provided a displaceable support for rotatably mounting the diamond roller, and a guide element guides the support such that the rotatable diamond roller is movable in a direction substantially perpendicular to the surface of the grinding element. Means serve to measure the path of displacement of the displaceable support and for delivering a signal, corresponding to the measured displacement path of the displaceable support, to control means for interrupting grinding of the grinding element by the diamond roller upon reaching a predetermined amount of wear of the grinding element and/or alerting an operator upon reaching a predetermined amount of wear of the grinding element.

As an alternative solution there can be provided a displaceable support for rotatably mounting the diamond roller, a threaded spindle having threading and a guide element having threading of opposite pitch to the threading of the threaded spindle. The threaded spindle is guided in the guide element and supports the displaceable support such that the rotatable diamond roller is movable in a direction substantially perpendicular to the surface of the grinding element. Furthermore, there is provided a motor having a motor shaft connected with the threaded spindle, and a pulse generator, such as a pulse wheel, is provided for the motor shaft for generating pulses. A pulse counter cooperates with the pulse generator for counting the pulses generated by the pulse generator. A connection line operatively connects the pulse counter with control means for delivering a signal representative of the counted pulses to the control means for interrupting grinding of the grinding element by the diamond roller upon reaching a predetermined amount of wear of the grinding element and/or alerting an operator upon reaching a predetermined amount of wear of the grinding element.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the figures of the drawings there have been generally used the same reference characters to denote the same elements, and wherein:

FIG. 1 is a fragmentary partially schematic cross-sectional illustration of a grinding apparatus constructed according to the present invention, the section being taken substantially along the section line II—II of FIG. 2;

FIG. 2 is a longitudinal sectional view of the grinding apparatus depicted in FIG. 1, taken substantially along the section line I—I thereof;

FIG. 11 illustrates a modified embodiment of a detail of the inventive grinding apparatus, as viewed looking in the direction of the arrow VI of FIG. 12;

FIG. 12 illustrates the detail of the inventive grinding apparatus depicted in FIG. 11, as viewed looking in the direction of the arrow VII of FIG. 11; and FIG. 13 illustrates the detail of the inventive grinding apparatus depicted in FIG. 11, as viewed looking in the direction of the arrow VIII of FIG. 11.

DETAILED DESCRIPTION OF THE PREFERRED EMBODIMENTS

Describing now the drawings, it is to be understood that only enough of the construction of the apparatus for grinding the clothing of a textile machine has been depicted therein, in order to simplify the illustration, as needed for those skilled in the art to readily understand the underlying principles and concepts of the present invention.

Figures 3, 6:
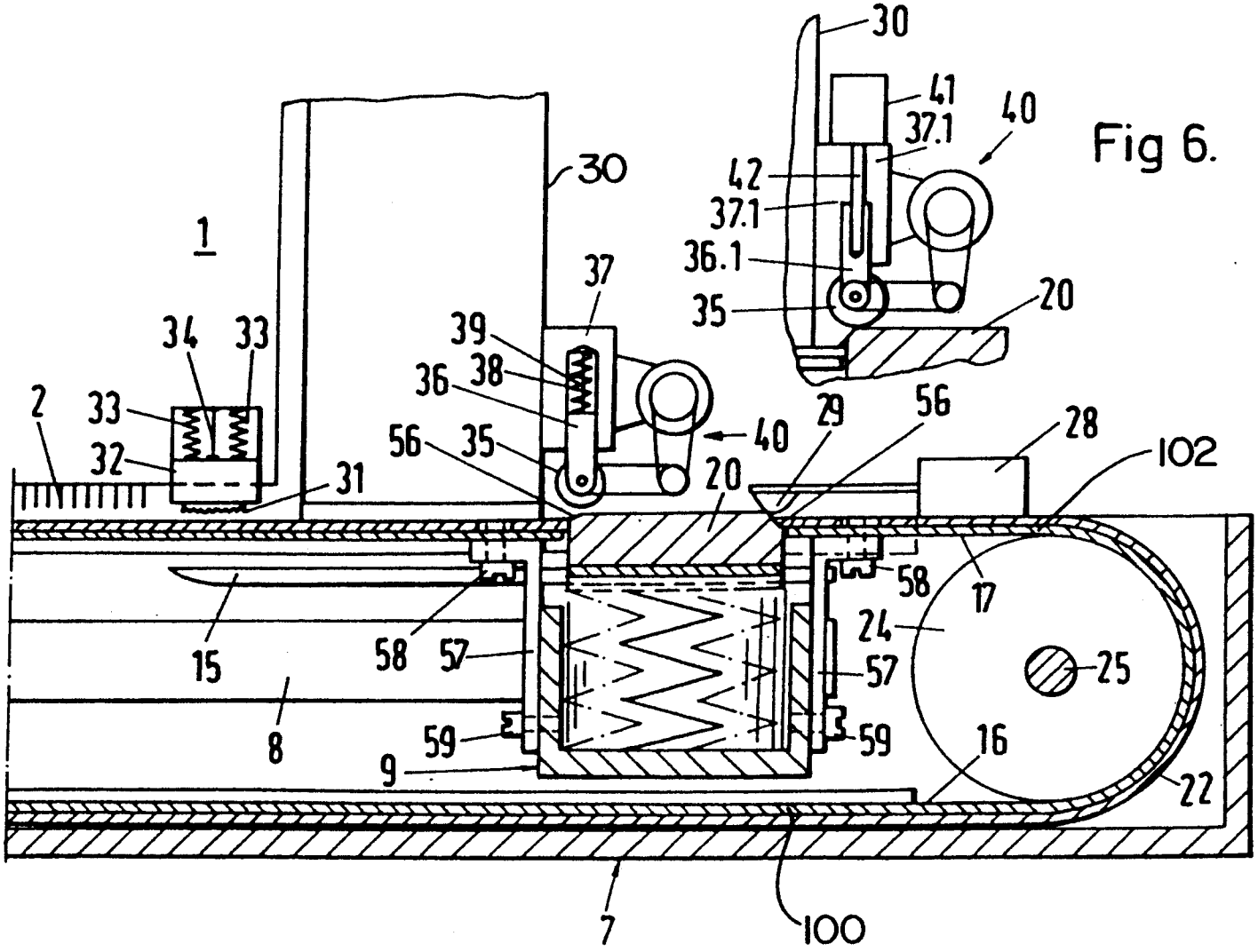
FIG. 3 is a longitudinal sectional view of the grinding apparatus depicted in FIG. 1, taken substantially along the section line III—III thereof.
FIG. 6 illustrates a modification of an element of the grinding apparatus depicted in FIG. 3.

Turning attention now to the exemplary embodiment of apparatus for grinding the clothing of a textile machine as depicted in FIGS. 1 to 3, it will be seen that there has been illustrated a carding element which, here, by way of example, comprises a cylinder 1 which may be, for instance, a main carding cylinder, equipped with clothing 2. However, in consideration of what has been previously explained, it should be appreciated that conceptually this cylinder 1 also may be considered to be a licker-in covered with clothing 2, a doffer covered with clothing 2, or even a revolving flat covered with such clothing 2.

Figures 4, 5:
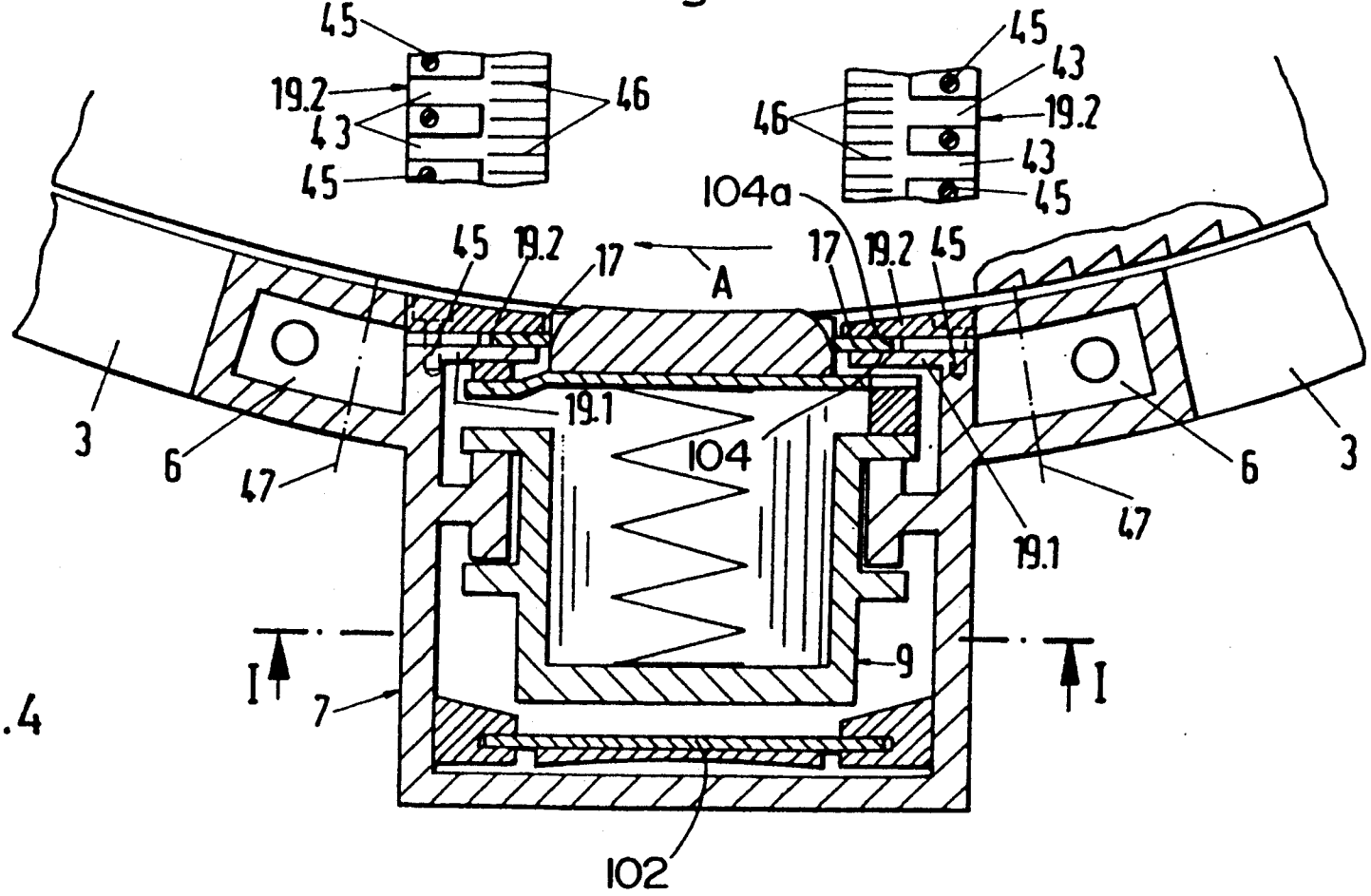
FIG. 4 depicts the grinding apparatus of FIG. 1 embodying certain modifications and depicted on a somewhat enlarged scale.
FIG. 5 illustrates details of part of the grinding apparatus of FIG. 4.
Figure 8:
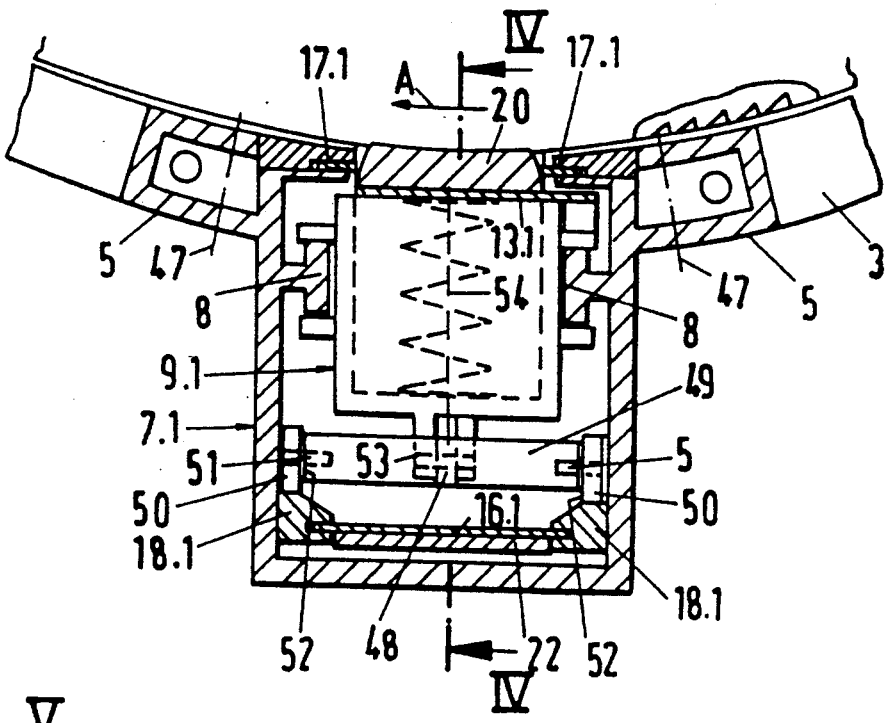
FIG. 8 is a sectional view of the grinding apparatus depicted in FIG. 7, taken substantially along the section line V—V thereof.

At card flanges 30 (see, for instance FIG. 3) or equivalent structure, as symbolically indicated with chain-dot lines 47 in FIGS. 1, 4 and 8 there are secured about the main carding cylinder 1 clothing rods or covers 3 and between such clothing rods or covers 3 a grinding apparatus 4 constructed according to the present invention.

The grinding apparatus 4 essentially comprises two wing or lateral portions 5 and a housing 7 located therebetween which, however, has the wing or lateral portions 5 integrated therewith. Each of these wing or lateral portions 5 comprises a respective hollow compartment or chamber 6.

A slide or carriage 9, defining an entrainment member, is displaceably mounted in the housing 7 by means of guide beams or guides 8 so as to enable this slide or carriage 9 to move over the clothing 2. These guide beams or guides 8 are here shown to be part of the housing 7. In order to enable such displaceable movement of the slide or carriage 9, and as will be best observed with reference to FIG. 1, both opposite sides of such slide or carriage 9 are provided with a respective upper guide flange 11 and a lower guide flange 10. Additionally, by means of an intermediate element or part 12 a blade or leaf spring 13 or equivalent resilient structure is mounted at the upper right-hand guide flange 11 of the slide or carriage 9 shown in FIG. 7.

This blade or leaf spring 13 serves to mount or support a suitable grinding element 20*a* , here specifically, by way of example, a grinding stone 20, by means of which there can be ground or sharpened the tips or points of the clothing 2. A compression or pressure spring 21, defining pressing means, is clamped between the blade or leaf spring 13 and the slide or carriage 9 in order to exert a sufficient pressure at the grinding stone 20 to reliably accomplish such grinding or honing of the tips or points of the clothing 2.

Continuing, it will be seen from FIGS. 2 and 3 that the slide 9 is operatively connected by entrainment means or elements 57 with an inner run 17 of a drive element 100, here an endless flexible drive belt or band 102, in order to move the slide or carriage 9 together with the grinding stone 20 over the clothing 2 so as to reliably perform the previously discussed grinding or sharpening of the tips or points of the clothing 2. In order to be able to revolving drive the endless drive belt or band 102 such is trained about a drive- and deflection roller 24 and at its lower region this endless drive belt or band 102 comprises an outer run 16.

The entrainment means or elements 57 are fixedly connected by threaded bolts or screws 58 with the inner run 17 of the endless drive belt 102 and by threaded bolts or screws 59 with the slide 9. To afford a relatively extensive free mobility of the grinding stone 20, the blade Or leaf spring 13, and equally a further blade or leaf spring 13.1 to be considered shortly with reference to FIGS. 11 to 13, each comprise a spring web 131 (see, in particular, FIG. 13) having a width H (FIGS. 2 and 13) for interconnecting the spring part 13*a* connected with the intermediate element 12 and the spring part 13*b* connected with the grinding stone 20. By way of completeness it is here remarked that the spring web width H can be empirically determined.

As shown in FIG. 1, the outer run 16 of the endless flexible drive belt 102 is guided by an outer band guide or guide means 18 and the inner run 17 of this endless flexible drive belt 102 is guided by an inner belt guide or guide means 19. To that end, these outer and inner guides 18 and 19 each contain a slot 104 within which there can be guided the endless flexible drive belt 102.

By reverting to FIG. 2, it will be recognized that instead of using a single spring 21 it is alternatively possible to use two springs 23, likewise defining pressing means, and something affording distinct advantages as will be considered more fully shortly.

Additionally, FIGS. 1 and 2 shown that the endless flexible drive belt or band 102 is provided with a fill covering or cover means 22 which is applied to the entire length of such endless flexible drive belt or band 102 except at that location where is arranged the grinding stone 20. In other words, this fill covering 22 neighbors both sides of the grinding stone 20 and serves the purpose of beneficially substantially filling the space before and after the grinding stone 20, as viewed in the lengthwise direction of the endless flexible drive belt or band 102, between the inner belt guides 19 such that there can not occur at this location any accumulation of fibers or contaminants.

By further inspecting FIG. 2, it will be observed that compressed or pressurized air connections 44 are connected with the wing portions 5, these compressed or pressurized air connections 44 opening into the hollow compartments 6 and the purpose of which will be discussed hereinafter.

FIG. 2 further reveals that the drive- and deflection roller 24 comprises a drive shaft or shaft member 25 and an axle 26, each of which are rotatably mounted in the housing 7.

With attention now directed to FIG. 3, there will be seen the slide or carriage 9 together with the grinding stone 20 located in an end or terminal position of their path of travel. This terminal position is reported to a suitable control (not shown) by means of an end or terminal switch 28 or the like, having a cam or dog 29 which is shifted by the grinding stone 20. Instead of the end switch 28 there can be used any other suitable end detection device, such as a proximity switch or initiator.

FIG. 3 also depicts a cam guide or guide 15 which is also shown in FIG. 1. This cam guide 15 guides the blade spring end 14 of the blade or leaf spring 13 at this end region of the entrainment path through which moves the slide 9 defining the entrainment member for the grinding stone 20.

Furthermore, FIG. 3 illustrates grinding members comprising a diamond rake or squeegee 31 and a diamond roller or wheel 35 containing diamond dust for re-grinding the employed grinding stone, such as here the grinding stone 20. As a practical matter, however, there would be used either the diamond rake or squeegee 31 or the diamond roller or wheel 35. This diamond rake or squeegee 31 is mounted at a support or carrier 32 which is guided in the main carding cylinder 1, and thus, is here shown located at an end region of the main carding cylinder 1. Moreover, such diamond rake or squeegee 31 is biased by two compression or pressure springs 33 against the grinding stone 20, however, not farther than permitted by a path limiter 34. The diamond roller or wheel 35 is arranged externally of the main carding cylinder 1.

As also shown in FIG. 3, the cam guide 15 projects in the direction of the card clothing 2 to such an extent that the blade spring end or end portion 14 of the blade 13 is guided by this cam guide 15 during such time as the grinding stone 20 is guided over the diamond rake 31. The grinding stone 20 is fixed in its position upon passing over the diamond rake 31 owing to the force of the spring 21 or the springs 23 and the guidance exerted by means of the cam guide 15, so that only the diamond rake 31 is moved and, as already explained, can be pressed by the springs 33 against the grinding stone 20.

By virtue of the rounded or arcuate portions 56 (FIG. 3) provided at the grinding stone 20 there is eliminated the danger of damage to the diamond rake or squeegee 31 or the grinding stone 20 upon contact of the grinding stone 20 with the diamond rake or squeegee 31.

As already previously mentioned, instead of using the diamond rake or squeegee 31 there can be used the rotatable diamond roller or wheel 35 which is rotatably mounted in a support or carrier 36. This support or carrier 36, in turn, is guided in a guide element 37 secured to one of the card flanges 30. A compression or pressure spring 38 serves to press the diamond roller or wheel 35 against the grinding stone 20, the displacement stroke of which, analogous to the path limiting of the diamond rake or squeegee 31 as previously considered, is limited by a path limiter 39. Furthermore, a drive 40 serves to rotatably drive the diamond roller or wheel 35.

FIG. 6 illustrates a variant of the arrangement of the diamond roller or wheel 35 of FIG. 3 inasmuch as here the support or carrier 36.1 is not moved by a spring towards the grinding stone 20, rather by a driven spindle 42. This driven spindle 42 is displaceably driven by a spindle drive motor 41. Such spindle drive motor 41 is attached to a guide element 37.1 which, in turn, like the previously considered guide element 37, is secured to one of the card flanges 30. Also in this case the diamond roller or wheel 35 is rotatably driven by a suitable drive or drive means 40.

A notable advantage realized through the closure of the housing 7 by the drive belt or band 102 and the grinding stone 20 resides in the fact that there can be advantageously precluded filling of the interior of such housing 7 with fibers.

The arrangement of FIG. 4 is furthermore concerned with the avoidance of fiber accumulations at the guide surfaces 104*a* of the inner run 17 of the drive or transport belt or band 102, in the air channels or air entry openings 43 which flow communicate the slots 104 guiding such inner run 17 with the related hollow compartment or chamber 6, so that the compressed air which is introduced by means of the compressed or pressurized air connections 44, defining a compressed air source, can be blown through the air channels or air entry openings 43 into such guide slots 104. As a result, there is generated an air flow which prevents arrival of fibers at such guide slots 104.

In order to be able to better distribute the air beneath and above the run belt 17 guided in the slots 104 of the inner belt guides 19 and as will be seen from FIG. 5, grooves 46 are provided in the guide surfaces 104*a* of these slots 104, so that the air can forwardly advance or move between the slot guide surfaces and the drive belt surfaces. In this way, there is prevented that only one of the guide surfaces will be impinged with air. These grooves 46 are arranged at substantially right angles to the predetermined direction of movement of the flexible drive belt 102 and extend substantially throughout the entire width of the region of contact of the flexible drive belt 102 at the guide surfaces 104*a*. Furthermore, this contact region extends in the same direction as the predetermined direction of movement of the flexible drive belt 102.

For this purpose the inner belt guides 19 depicted in FIG. 1 are sub-divided in the arrangement of FIG. 5 into a lower belt or band guide portion 19.2 and an upper belt or band guide portion 19.1, so that the grooves 46 can be formed in both belt guide surfaces of the slots 104, and the lower belt or band guide portion 19.2 is affixed by threaded bolts or screws 45 to the upper belt or band guide portion 19.1.

At this juncture it will be recalled that in connection with FIGS. 1 and 3 there was explained the purpose of the cam guide 15. Based upon the showing of FIGS. 7 and 8 there will be now considered an alternative construction of cam guide or guide means for raising or shifting the blade or leaf spring 13.1.

This modified construction is predicated upon a design wherein a tension or traction lever 48 is pivotally mounted upon a slide or carriage 9.1 at a pivot axle or shaft 53. This pivot axle or shaft 53 constitutes part of a pivot bearing 55 secured at the slide or carriage 9.1. One end 48*a* of the tension or traction lever 48 is fastened to a tension or traction cable 54 which likewise is connected with the blade or leaf spring 13.1. The other end 48*b* of this tension or traction lever 48 is equipped with a transverse beam member 49, at the opposite ends of which there are rotatably arranged rollers 50 by means of the rotatable axles or shafts 51.

Figure 7:
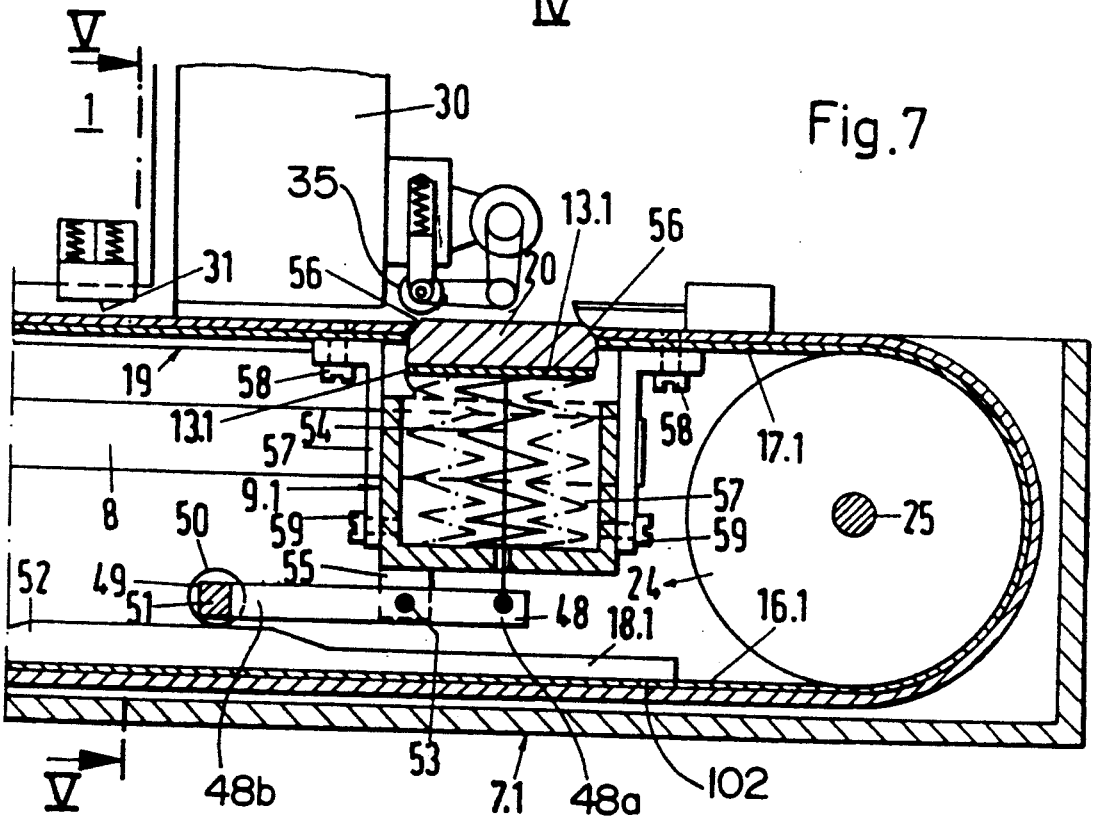
FIG. 7 illustrates in sectional view a modified embodiment of grinding apparatus according to the present invention, taken substantially along the section line IV—IV of FIG. 8.

Now if the slide or carriage 9.1 is shifted by the endless drive belt or band 102 into the terminal position depicted in FIG. 7, then the rollers 50 are each guided by the cam guides 52 located at opposite ends of the transverse beam member 49 in such a manner that, with respect to the showing of FIG. 7, these rollers 50 perform an upward movement. As a consequence thereof, the traction cable 54 retracts the blade or leaf spring 13.1 into a predetermined position in which the grinding stone 20 is ground or sharpened either by the diamond rake or squeegee 31 or the diamond roller or wheel 35. At the same time there is thus realized a gentle contact of the grinding stone 20 with the clothing 2.

In the modified embodiment of FIGS. 7 and 8 there has not been illustrated, in order to simplify the showing, the fill covering 22 which was depicted in FIGS. 1 and 2. The convenient omission of the illustration of such fill covering 22 in FIGS. 7 and 8 is not to be construed, however, that such fill covering can not also be here provided.

Figure 10:
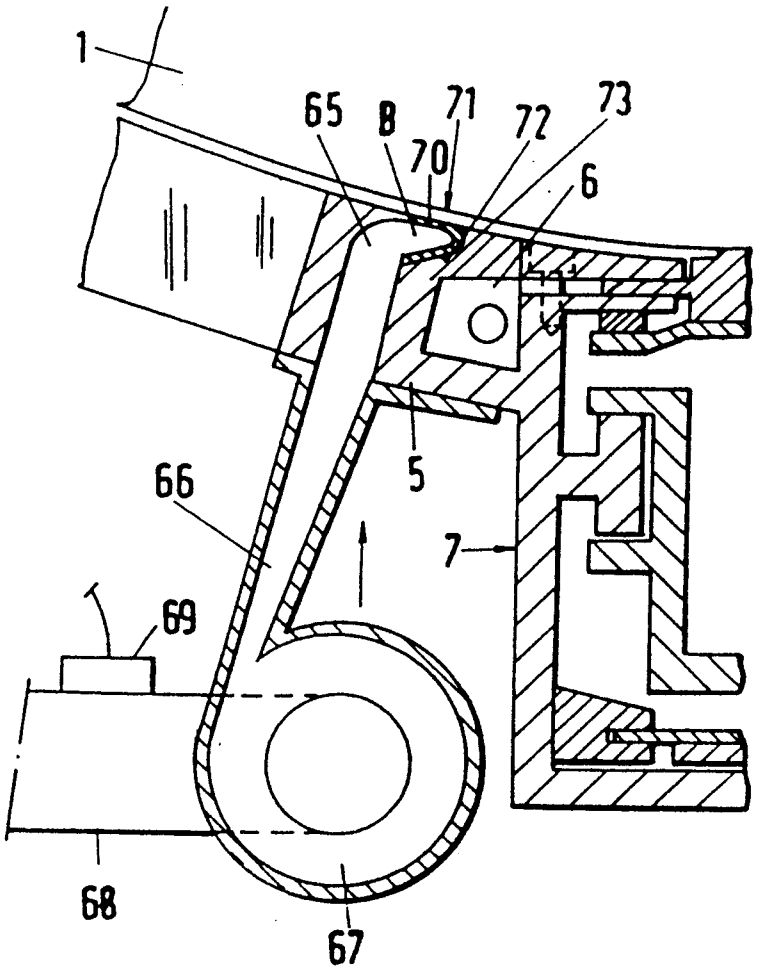
FIG. 10 illustrates a modification of an element of the grinding apparatus depicted in FIG. 9.
Figure 9:
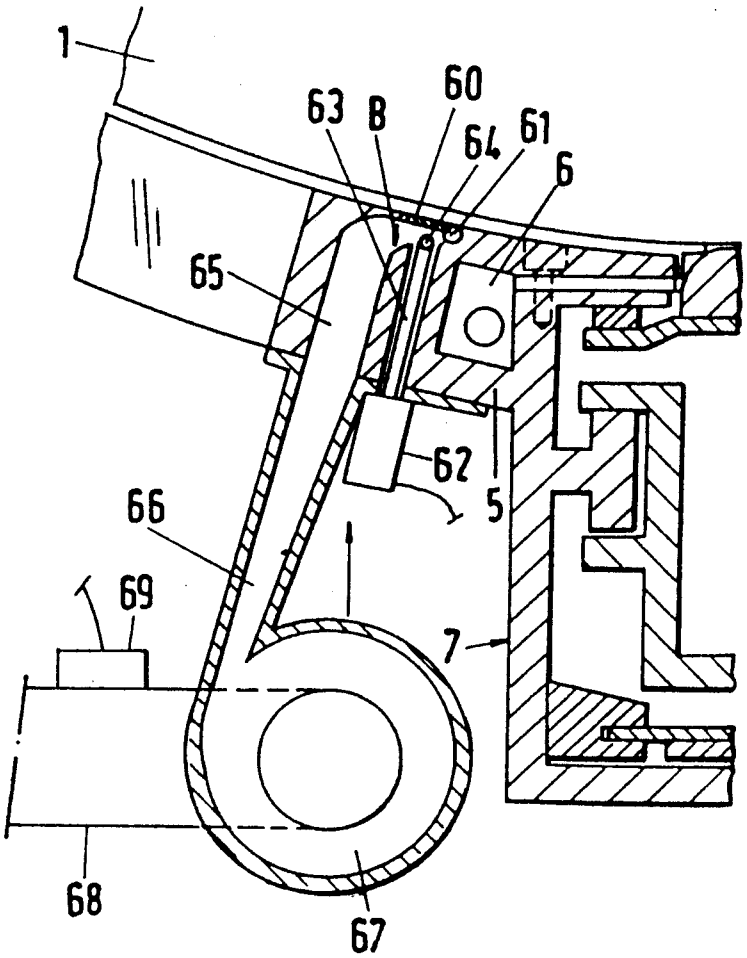
FIG. 9 illustrates a further modified embodiment of the grinding apparatus according to the present invention.

FIGS. 9 and 10 depict the possibility of suctionally removing grinding dust even if such is only present in smaller quantities, so that there is essentially prevented deposition of such grinding dust in the fiber material.

For this purpose, the arrangement of FIG. 9 is shown provided with a suction nozzle 65 and a controllable closure flap or valve 60 which closes such suction nozzle 65. This closure flap 60 is hingedly connected by a hinge or pivot 61 at the associated wing or lateral portion 5. As further shown in FIG. 9, this wing or lateral portion 5 is appropriately modified in its construction in relation to the associated wing or lateral portions 5 previously considered with reference to prior discussed figures of the drawings. The suction nozzle 65 is arranged after the grinding stone 20 as viewed with respect to the rotational direction of the main carding cylinder 1.

In order to be able to move the closure flap 60 the latter is connected by a hinge or pivot connection 64 with a piston rod 63 of a displacement or lifting element 62. This displacement or lifting element 62 is stationarily arranged. Moreover, such displacement or lifting element 62 can comprise, for instance, a magnet provided with means exerting a spring force and such spring force closes the closure flap 60 and the magnetic force opens the closure flap 60.

Continuing, it is here pointed out that the suction nozzle 65 possesses a length corresponding at least to the entire width of the main carding cylinder 1. A suction channel 66 merges with the suction nozzle 65. This suction channel 66 tangentially opens at an air collection conduit or line 67. At one end of the air collection conduit 67 there is connected a suction conduit or line 68 which can be optionally provided with a fire alarm or monitor 69.

The embodiment of FIG. 10 essentially contains the same elements as in FIG. 9, except that here the closure flap 60 of the arrangement of FIG. 9 is replaced by a closure lip member 70 which is part of a closure element 71. This closure element 71 furthermore contains an attachment leg member 72 which is connected by suitable attachment means 73, schematically indicated by chain-dot lines, at the associated wing or lateral portion 5.

The suction action provided by the suction nozzle 65 is undertaken only during grinding, that is to say, at all other times the suction is disconnected and, as shown in FIGS. 9 and 10, the respective closure flap 60 and closure lip member 70 remain closed. During grinding, the closure flap 60 is opened in the opening direction B and this is accomplished by the controlled displacement or lifting element 62. In other words, the suction through the suction nozzle 65 is synchronized with the opening of the closure flap 60.

In the arrangement of FIG. 10 the synchronization of the opening of the closure lip member 70 is accomplished automatically by the negative pressure or vacuum prevailing in the suction nozzle 65. In other words, the closure element 71 exhibits such an elastic force that the closure lip member 70 remains closed when a negative pressure is not present in the suction nozzle 65.

It is here mentioned that the grinding can be undertaken either during operation of the card, that is during carding of the fibers or following stopping of the card. The maintenance intervals between the grinding intervals must be empirically determined.

It is equally not absolutely necessary to provide the aforementioned diamond rake or squeegee 31 or the diamond roller or wheel 35, since the possibility also exists to exchange the grinding stone 20. To that end, suitable connection means, such as threaded bolts or screws (not shown) serve to connect the grinding stone 20 with the associated blade or leaf springs 13 and 13.1, as the case may be.

FIGS. 11 to 13 depict an arrangement where the grinding stone 20.1 constitutes a modification of the previously considered grinding stone 20 discussed in conjunction with the prior explained figures of the drawings. This grinding stone 20.1 possesses a reduced width F in relation to the width of the previously considered grinding stone 20 and which amounts to between 10 mm. and 15 mm. In contrast, the width of the grinding stone 20 amounts to approximately 30 mm. by way of example.

An advantage afforded through the use of the grinding stone 20.1 having the reduced width F is that this grinding stone 20.1 tends to clog less with the grinding dust, that is to say, to a certain extent has a self-cleaning action. However, it is to be expressly understood that the exemplary given reduced width F of the grinding stone 20.1 is not to be considered in any way as an absolute limitation, rather depending upon the nature, especially the porosity of the used grinding stone such can have another optimum grinding stone width, something which can be empirically determined. What is of importance is the fact that there should be selected a grinding stone width which provides a self-cleaning action.

This grinding stone 20.1 is fixed in place, on the one hand, by an attachment bracket member 74 and, on the other hand, by a magnetic plate 76. To that end, the attachment bracket member 74 is connected by threaded bolts or screws 75 and the magnetic plate 76 by threaded bolts or screws 77 with the blade or leaf spring 13 or 13.1, as the case may be. As will be observed from FIG. 11, the magnetic plate 76 is provided after the grinding stone 20.1, as viewed in the direction of movement A of the main carding cylinder 1, so that the metallic grinding dust formed as a result of the grinding operation adheres to the magnetic plate 76.

Regarding a variant construction, a trough or depression 78 of a magnetic plate 76.1 can be provided for the reception of the grinding dust. This modification has the advantage that there is less danger during grinding of the clothing 2 of the main carding cylinder 1 with the presence of a fiber covering or layer at such clothing 2 that the grinding dust will be less intensively propelled away by such fiber covering or layer. FIGS. 11 and 12 further depict that the magnetic plate 76.1 protrudes at both ends by an amount W past the grinding stone 20.1. The same end-protrusion possibility also can be provided for the magnetic plate 76. In this manner there is advantageously provided a catch surface for the grinding dust which extends beyond the length L of the grinding stone 20.1.

In FIGS. 11 to 13 there has been illustrated the pivotability of the respective blade or leaf springs 13 and 13.1 about the pivot axis S and the rotatability of such blade or leaf springs 13 and 13.1 about the rotational axis D, wherein the pivotal movement is represented by reference character S.1 and the rotational movement by reference character D.1. Additionally, there is here again shown the spring web 131 having the width H. This spring web width H, as viewed in the predetermined direction of movement of the grinding stone 20 or 20.1 amounts to a fraction of the length of such grinding stone 20 or 20.1.

As will be seen from FIG. 11, a height difference G is present between the grinding stone 20.1 and the magnetic plate 76. The grinding stone 20.1 can wear down within this height difference G.

Figure 3A:
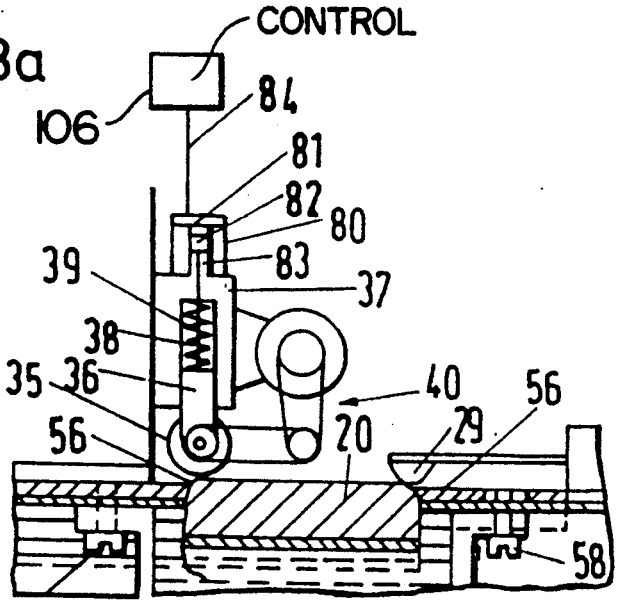
FIG. 3*a* illustrates a modification of the grinding apparatus depicted in FIGS. 1 to 3, and specifically with respect to certain of the structure shown in FIG. 3.

Finally, at this junction of the description it is remarked that the possibility exists of monitoring the degree of wear of the grinding stone 20 or 20.1, as the case may be. In particular, as shown in FIG. 3*a* a guide cylinder 80 is connected with the guide element 37 and a proximity piston 82 displaceably guided in the guide cylinder 80 has exactly the same displacement stroke or path as the support or carrier 36, supporting the diamond roller 35 for movement substantially perpendicular to the surface of the grinding stone 20 or 20.1, due to the provision of a plunger 83 connected with such support or carrier 36. The movements of the proximity piston 82 are sensed by a contactless proximity switch 81, in other words, the proximity switch 81 senses the distance between the proximity piston 82 and the proximity switch 81 and by means of a connection line or lead 84 delivers signals corresponding to such detected distance to a suitable control 106 which, upon reaching a predetermined or preset wear of the grinding stone 20 or 20.1 as the case may be,, delivers a warning or alarm or alerting signal to the operator and/or stops the movement of the grinding stone 20 or 20.1, respectively, in its starting position.

Figure 6A:
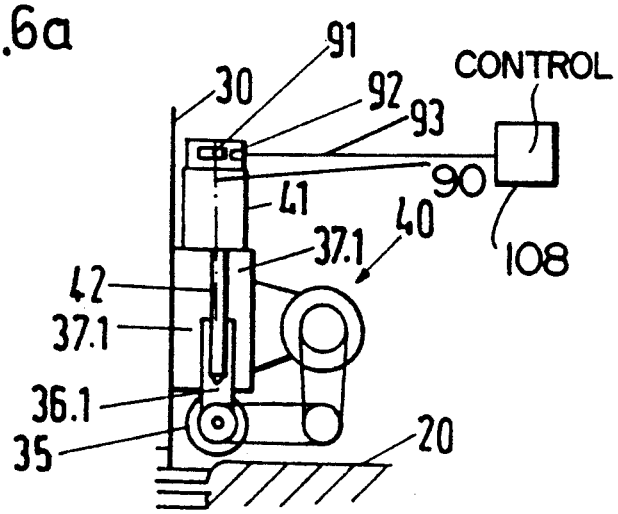
FIG. 6*a* illustrates a further modification of the grinding apparatus depicted in FIG. 3.

The modification of FIG. 6*a* depicts the same function, however, employing different means to do so in that, here, a shaft 90 of motor 41 is provided at the shaft end located opposite to spindle 42 with a suitable pulse transmitter, here a pulse wheel 91 situated opposite a pulse counter 92. This pulse counter 92 counts the pulses delivered by the pulse wheel 91 and delivers such pulse count in the form of appropriate signals via a connection line or lead 93 to a suitable control 108 which, upon reaching a predetermined or pre-set wear of the grinding stone 20 or 20.1 as the case may be,, delivers a warning or alarm or alerting signal to the operator and/or stops the movement of the grinding stone 20 or 20.1, respectively, in its starting position. It is further noted that the spindle 42 mounts the support or carrier 36 supporting the diamond roller 35 for movement substantially perpendicular to the surface of the grinding stone 20 or 20.1. This spindle 42 has threading of opposite pitch to the threading of a guide element 37.1 in which there is threadably received such spindle 42.

While there are shown and described present preferred embodiments of the invention, it is distinctly to be understood the invention is not limited thereto, but may be otherwise variously embodied and practiced within the scope of the following claims.

What is claimed is:

1. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element;

guide means for displaceably guiding the entrainment member;

drive means for moving the entrainment member over the clothing in order to accomplish the movement of the grinding element essentially perpendicular to the predetermined direction of movement of the clothing;

the drive means comprising a flexible drive belt;

guide means for guiding the flexible drive belt;

means for operatively connecting the flexible drive belt with the grinding element in order to move the grinding element over the clothing; and the flexible drive belt being connected with the entrainment member in such a manner and the guide means for guiding the flexible belt being arranged in such a manner that the flexible drive belt and the grinding element conjointly seal a space directly beneath the clothing.

2. The apparatus according to claim 1, wherein:

the carding element at which there is mounted the clothing comprises a main carding cylinder of a carding machine.

3. The apparatus according to claim 2, wherein:

the main carding cylinder has a predetermined width; and the drive means moving the entrainment member and thus the grinding element substantially throughout the entire predetermined width of the main carding cylinder.

4. The apparatus according to claim 1, wherein:

the carding element at which there is mounted the clothing comprises a licker-in of a carding machine.

5. The apparatus according to claim 1, wherein:

the carding element at which there is mounted the clothing comprises a doffer of a carding machine.

6. The apparatus according to claim 1, wherein:

the carding element at which there is mounted the clothing comprises a revolving flat of a carding machine.

7. The apparatus according to claim 1, wherein:

the entrainment member comprises a slide.

8. The apparatus according to claim 1, wherein:

the flexible drive belt has a predetermined direction of movement;

the clothing and the flexible drive belt defining therebetween a space; and cover means provided for the flexible drive belt before and after the grinding element, as viewed with respect to the predetermined direction of movement of said flexible drive belt, for substantially filling the space between the clothing and the flexible drive belt.

9. The apparatus of claim 1, further including:

pressing means for pressing the grinding element against the clothing.

10. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element;

guide means for displaceably guiding the entrainment member;

drive means for moving the entrainment member over the clothing in order to accomplish the movement of the grinding element essentially perpendicular to the predetermined direction of movement of the clothing;

the drive means comprising a flexible drive belt;

guide means for guiding the flexible drive belt;

means for operatively connecting the flexible drive belt with the grinding element in order to move the grinding element over the clothing;

the guide means for guiding the flexible drive belt being provided with air entry openings; and compressed air source means for blowing in compressed air through the air entry openings.

11. The apparatus according to claim 10, wherein:

the flexible drive belt has a predetermined direction of movement;

the guide means for guiding the flexible drive belt comprise guide surfaces;

said guide surfaces being provided with groove means arranged substantially at right angles to the predetermined direction of movement of the flexible drive belt and extending substantially throughout the entire width of the region of contact of the flexible drive belt at the guide surfaces; and said region of contact of the flexible drive belt at the guide surfaces extending in the same direction as the predetermined direction of movement of the flexible drive belt.

12. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element;

guide means for displaceably guiding the entrainment member;

drive means for moving the entrainment member over the clothing in order to accomplish the movement of the grinding element essentially perpendicular to the predetermined direction of movement of the clothing;

the drive means comprising a flexible drive belt;

guide means for guiding the flexible drive belt;

means for operatively connecting the flexible drive belt with the grinding element in order to move the grinding element over the clothing;

pressing means for pressing the grinding element against the clothing; and the pressing means for pressing the grinding element against the clothing comprising spring means.

13. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element, said entrainment member comprising a slide;

guide means for displaceably guiding the entrainment member;

drive means for moving the entrainment member over the clothing in order to accomplish the movement of the grinding element essentially perpendicular to the predetermined direction of movement of the clothing;

the drive means comprising a flexible drive belt;

guide means for guiding the flexible drive belt;

means for operatively connecting the flexible drive belt with the grinding element in order to move the grinding element over the clothing;

pressing means for pressing the grinding element against the clothing;

the grinding element having a predetermined length and a predetermined direction of movement;

said operatively connecting means comprising a blade spring for connecting the grinding element with the slide;

the blade spring having a spring web located over the grinding element which sis extensively freely movable;

said spring web being located between the slide and the grinding element; and the spring web having a width, as viewed in the predetermined direction of movement of the grinding element, constituting a fraction of the predetermined length of the grinding element.

14. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element;

guide means for displaceably guiding the entrainment member;

drive means for moving the entrainment member over the clothing in order to accomplish the movement of the grinding element essentially perpendicular to the predetermined direction of movement of the clothing;

means for operatively connecting the drive means with the grinding element in order to move the grinding element over the clothing; and a grinding member for re-grinding the grinding element.

15. The apparatus according to claim 14, wherein:

the grinding member for re-grinding the grinding element comprises a diamond rake.

16. The apparatus according to claim 15, wherein:

the diamond rake is arranged externally of the clothing at an edge of a main carding cylinder defining the carding element.

17. The apparatus according to claim 14, wherein:

the grinding member for re-grinding the grinding element comprises a diamond roller covered with diamond dust.

18. The apparatus according to claim 17, wherein:

the diamond roller covered with diamond dust is arranged externally of a main carding cylinder defining the carding element.

19. The apparatus according to claim 14, further including:

additional guide means for guiding the grinding element for re-grinding thereof by the grinding member at a sufficient distance from the clothing and externally of a card flange defining an end wall of a card constituting the textile machine.

20. The apparatus according to claim 19, wherein:

said additional guide means are structured for guiding the grinding element for re-grinding thereof at both sides of the clothing.

21. The apparatus according to claim 14, wherein:

the drive means comprising a flexible drive belt.

22. The apparatus according to claim 21, further including:

guide means for guiding the flexible drive belt.

23. The apparatus according to claim 17, wherein:

the grinding element has a surface;

a displaceable support for rotatably mounting the diamond roller;

a guide element for guiding the support such that the rotatable diamond roller is movable in a direction substantially perpendicular to the surface of the grinding element;

control means; and means for measuring a path of displacement of the displaceable support and for delivering a signal corresponding to the measured displacement path of the displaceable support to the control means for at least interrupting grinding of the grinding element by the diamond roller upon reaching a predetermined amount of wear of the grinding element.

24. The apparatus according to claim 17, wherein:

the grinding element has a surface;

a displaceable support for rotatably mounting the diamond roller;

a guide element for guiding the support such that the rotatable diamond roller is movable in a direction substantially perpendicular to the surface of the grinding element;

control means; and means for measuring a path of displacement of the displaceable support and for delivering a signal corresponding to the measured displacement path of the displaceable support to the control means for at least alerting an operator upon reaching a predetermined amount of wear of the grinding element.

25. The apparatus according to claim 17, wherein:

the grinding element has a surface;

a displaceable support for rotatably mounting the diamond roller;

a threaded spindle having threading;

a guide element having threading of opposite pitch to the threading of the threaded spindle;

the threaded spindle being guided in the guide element;

the threaded spindle supporting the displaceable support such that the rotatable diamond roller is movable in a direction substantially perpendicular to the surface of the grinding element;

a motor having a motor shaft connected with the threaded spindle;

a pulse generator provided for the motor shaft for generating pulses;

a pulse counter cooperating with the pulse generator for count the pulses generated by the pulse generator;

control means;

connection line means for operatively connecting the pulse counter with the control means for delivering a signal representative of the counted pulses to the control means for at least interrupting grinding of the grinding element by the diamond roller upon reaching a predetermined amount of wear of the grinding element.

26. The apparatus according to claim 25, wherein:

the pulse generator comprises a pulse wheel.

27. The apparatus according to claim 17 wherein:

the grinding element has a surface;

a displaceable support for rotatably mounting the diamond roller;

a threaded spindle having threading;

a guide element having threading of opposite pitch to the threading of the threaded spindle;

the threaded spindle being guided in the guide element;

the threaded spindle supporting the displaceable support such that the rotatable diamond roller is movable in a direction substantially perpendicular to the surface of the element;

a motor having a motor shaft connected with the threaded spindle;

a pulse generator provided for the motor shaft for generating pulses;

a pulse counter cooperating with the pulse generator for count the pulses generated by the pulse generator;

control means;

connection line means for operatively connecting the pulse counter with the control means for delivering a signal representative of the counted pulses to the control means for at least alerting an operator upon reaching a predetermined amount of wear of the grinding element.

28. The apparatus according to claim 27, wherein:

the pulse generator comprises a pulse wheel.

29. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element;

guide means for displaceably guiding the entrainment member;

drive means for moving the entrainment member over the clothing in order to accomplish the movement of the grinding element essentially perpendicular to the predetermined direction of movement of the clothing;

the drive means comprising a flexible drive belt;

guide means for guiding the flexible drive belt;

means for operatively connecting the flexible drive belt with the grinding element in order to move the grinding element over the clothing;

additional guide means for guiding the grinding element at a sufficient distance from the clothing and externally of a card flange defining an end wall of a card constituting the textile machine to enable replacement of the grinding element.

30. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element;

guide means for displaceably guiding the entrainment member;

drive means for moving the entrainment member over the clothing in order to accomplish the movement of the grinding element essentially perpendicular to the predetermined direction of movement of the clothing;

the drive means comprising a flexible drive belt;

guide means for guiding the flexible drive belt;

means for operatively connecting the flexible drive belt with the grinding element in order to move the grinding element over the clothing;

the carding element at which there is mounted the clothing comprising a main carding cylinder of a carding machine;

the main carding cylinder having a predetermined direction of rotation; and a magnetic plate arranged after the grinding element with respect to the predetermined direction of rotation of the main carding cylinder.

31. An apparatus for grinding clothing of a textile machine having a carding element at which there is mounted the clothing moving in a predetermined direction, comprising:

a grinding element movable essentially perpendicular to the predetermined direction of movement of the clothing;

an entrainment member for supporting the grinding element;

guide means for displaceably guiding the entrainment member;

drive means for moving the entrainment member over the clothing in order to accomplish the movement of the grinding element essentially perpendicular to the predetermined direction of movement of the clothing;

the drive means comprising a flexible drive belt;

guide means for guiding the flexible drive belt;

means for operatively connecting the flexible drive belt with the grinding element in order to move the grinding element over the clothing;

the carding element at which there is mounted the clothing comprising a main carding cylinder of a carding machine;

the main carding cylinder having a predetermined direction of rotation; and a suction nozzle arranged after the grinding element with respect to the predetermined direction of rotation of the main carding cylinder.

32. The apparatus according to claim 31, further including:

a controllable flap member for closing the suction nozzle.

* * * * *